US005293957A

United States Patent [19]

Lunden, Jr.

[11] Patent Number: 5,293,957

[45] Date of Patent: Mar. 15, 1994

[54] CONTAINER HOLDING ATTACHMENT INSERTABLE IN A TUBULAR LADDER RUNG

[76] Inventor: Charles K. Lunden, Jr., Box 4028, Union, Me. 04862

[21] Appl. No.: 51,971

[22] Filed: Apr. 26, 1993

Related U.S. Application Data

[63] Continuation-in-part of Ser. No. 828,159, Jan. 30, 1992, abandoned.

[51] Int. Cl.[5] ..... E06C 7/14

[52] U.S. Cl. ..... 182/129; 248/210; 248/315

[58] Field of Search ..... 182/129, 120; 248/315, 248/210, 211, 238, 312.1

[56] References Cited

U.S. PATENT DOCUMENTS

| | | | |
|---|---|---|---|
| 1,006,513 | 10/1911 | Tyreman | 248/315 X |
| 2,242,833 | 5/1941 | Nibur | 248/315 X |
| 4,702,446 | 10/1987 | Brown | 248/210 |
| 5,181,682 | 1/1993 | Indelicato | 248/210 |

FOREIGN PATENT DOCUMENTS 683720 12/1952 United Kingdom .

*Primary Examiner*—Alvin C. Chin-Shue

[57] ABSTRACT

A holder for a paint container having an open end and of a maximum cross sectional area adjacent that end, has a first portion shaped and dimensioned to hold the container adjacent its open end and a handle shaped and dimensioned to be inserted in and be supported by a tubular ladder rung. The handle has a rigid section rigidly connected to the first portion and its free end disposed at an angle away from the plane of the first portion. A plastic, hard surfaced sleeve encases the rigid section between the angled end thereof and the first portion with the extremity of the angled end protruding beyond the periphery of the sleeve to establish the maximum dimension of the handle in a direction normal to the plane. With the extremity of the angled end oriented towards the tread surface of the rung and the handle portion inserted in a rung, the weight of the containers brings the extremity into holding contact therewith.

3 Claims, 2 Drawing Sheets

CONTAINER HOLDING ATTACHMENT INSERTABLE IN A TUBULAR LADDER RUNG

The present invention is a continuation in part of application Ser. No. 07/828,159, filed Jan. 30, 1992, now abandoned.

BACKGROUND OF THE INVENTION

It has long been the practice, when painting while standing on a ladder, to hang a container for paint or other brush spreadable liquid by its bail from a rung thus to enable the painter to hold onto the ladder with both hands while changing his position and then to be able to hold onto the ladder with one hand with the other hand free to dip the brush into the paint and spread the paint on the wall against which the ladder leans.

This practice had the obvious disadvantageous features that the suspended container was behind the ladder and free to swing and various proposals have been made to support the containers in more accessible positions. Such proposals include the concept of providing holders for the paint containers which have supports to be inserted into and in some cases through the tubular rungs of a metal ladder with the paint container supported at one side thereof.

None of these, as far as I am aware, has been well received with principal causes for their non-acceptance, production costs, inadequate support for the containers and their bulk making shipping costly and storage a problem.

THE PRESENT INVENTION

The general objective of the present invention is to provide a ladder attachment having a first portion to support a paint container and a handle insertable in a tubular ladder rung then to securely hold the paint container, the attachment inexpensive to manufacture, easily packaged and well adapted to meet all the requirements of painters.

In accordance with the invention, that objective is attained with an attachment particularly adapted for use with disposable containers, which are circular in cross section and are available at most paint and hardware stores in sizes ranging from one pint to two quarts. Such containers are of maximum cross sectional area at or close to their open ends. Each attachment has first circular, rigid portion shaped and dimensioned to hold and support such a container of a selected size adjacent its open end and a handle shaped and dimensioned to be freely and loosely entered in a tubular ladder rung and then to be securely held therein by the weight of the paint in the container.

Tubular rungs are of different cross sectional sizes and shapes. Some such rungs are circular while others have flat tread surfaces but all have their lower or bottom sections hemispherical establishing a plane at the junction of their upper and lower sections. The ends of the rungs are welded to the sides of the ladders.

The handle includes a rigid portion rigidly connected to the first portion and has its free end angularly disposed away from the plane established by the first portion of the attachment and is encased between that end and the first portion by a hard surfaced, flexible plastic sleeve rendering the handle of a cross section such that the handle is a loose fit in a rung but also one that may be comfortably hand held. The extremity of the angularly disposed end protrudes beyond the periphery of the sleeve and establishes the maximum, vertical dimension of the handle which is such that with the paint container held by the first portion, the extremity of the upturned end is directed towards the tread surface of the rung as the handle is inserted therein. When the handle is in place, the weight of the paint in the container brings the extremity into secure holding contact with the interior of the rung.

In order that the weight and cost of the attachment may be minimized, both rigid portions are of a minimum thickness consistent with the required rigidity.

Other aspects of the invention will be apparent from the accompanying drawings, the specification and the claims.

BRIEF DESCRIPTION OF THE DRAWINGS

The accompanying drawings illustrate a presently preferred embodiment of the invention with FIG. 1 a fragmentary perspective view of a ladder with the attachment held in a rung thereof.

THE PREFERRED EMBODIMENT

Figure 1:
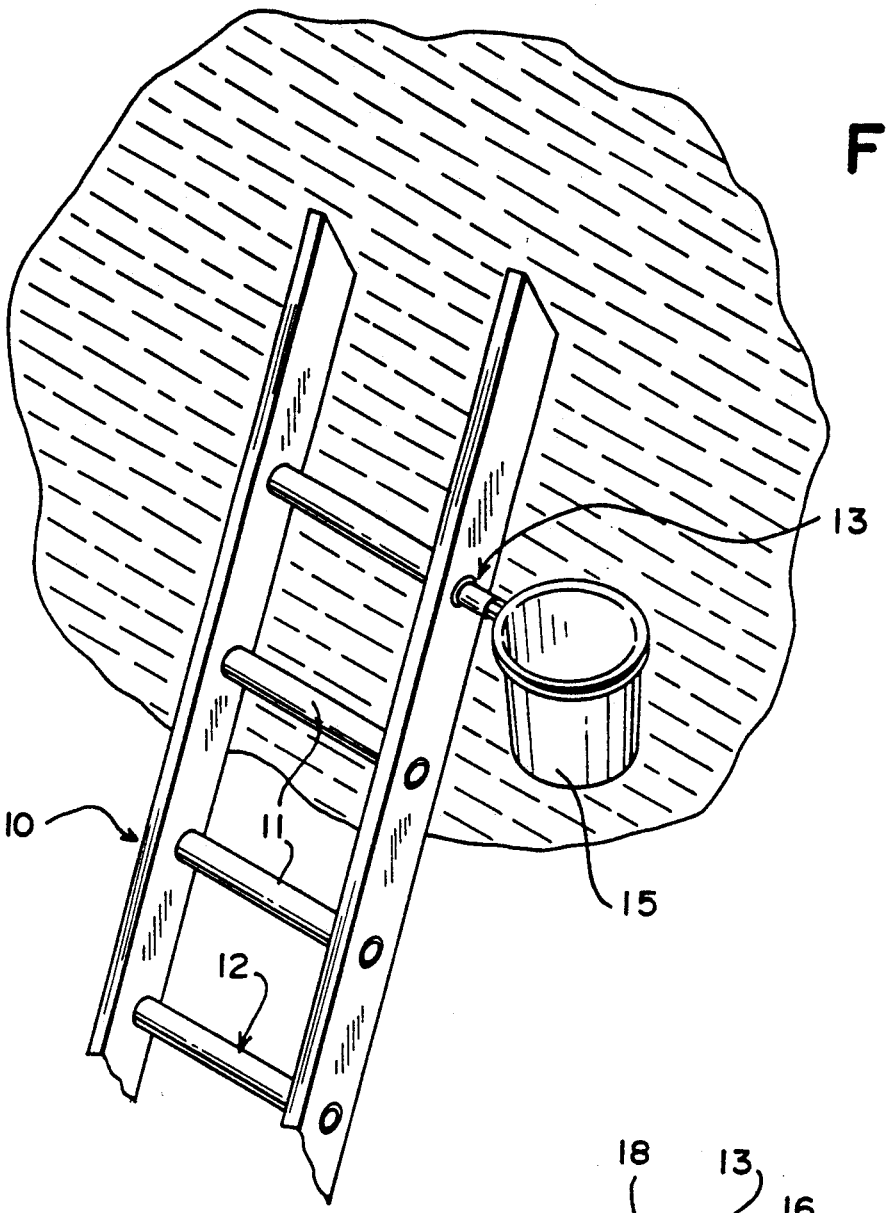
Figure 2:
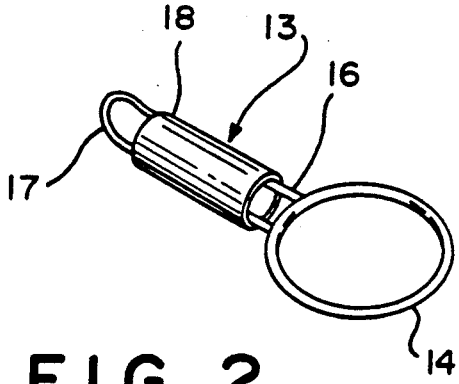
FIG. 2 is a plan view, on an increase in scale of the attachment.
Figure 3:
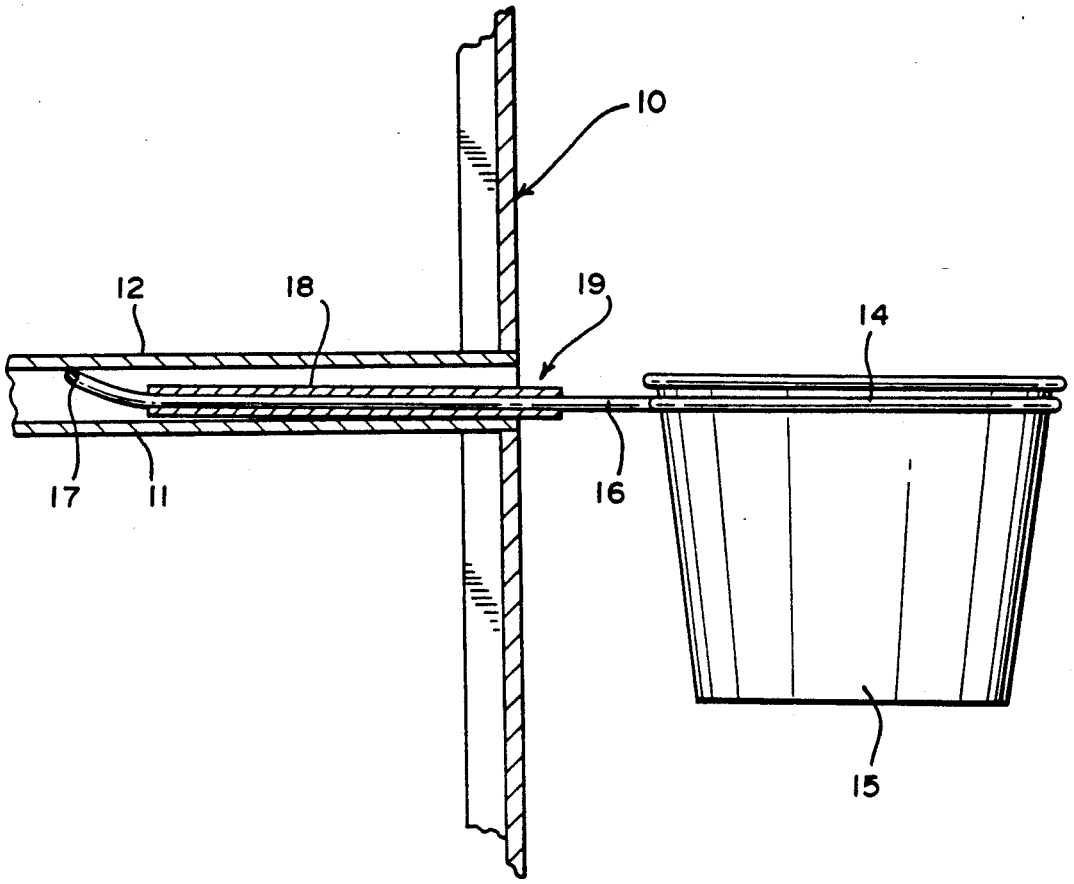
FIG. 3 is a view, on an increase in scale, showing the handle of the attachment as sectioned lengthwise and held in a rung.

In FIG. 1, a section of a conventional metal ladder, generally indicated at 10, is shown as having its tubular rungs 11 circular in cross section. It should be noted that in other such ladders, the rungs may have a flat tread with a rung width typically greater than that of the rungs 11. In either case, the distances from the under surfaces of the treads 12 of the rungs to the opposite interior zones are substantially the same.

The ladder attachment, generally indicated at 13, has a circular first portion 14 shaped and dimensioned to receive a disposable paint container 15 of a particular capacity and support it by holding it at or below its open end where the container 15 is of a maximum cross sectional area. In practice, the circular first portion 14 is formed of a length of cold rolled steel rod stock with its ends welded together or of other rod stock which may be similarly formed. Rod stocks of approximately three sixteenths of an inch in diameter are satisfactory for use with its ends welded together.

Such rod stock is also sufficiently rigid for the handle portion 16 of the attachment which is U-shaped and formed of the same rod stock with its ends welded to the first portion. The free end 17 of the handle portion 16 is bent at an angle away from the plane of the first portion and a plastic, hard surfaced sleeve 18 circular in cross section, frictionally encases the handle portion 16 between the angularly disposed end and the first portion 14 with the sleeve now oblate in cross section. In practice, the sleeve 18 is pushed on the handle portion 16 after the handle portion has been welded to the circular portion 14 but before the free end 16 is bent to establish the upper surface of the attachment. The sleeve 18 is preferably sufficiently flexible that it may be forced over that end after it has been bent and into its wanted position. Except for the upturned end 17, the two portions of the attachment are desirably in the same plane. The extremity of the upturned end 17 protrudes beyond the periphery of the sleeve 18 a distance which, when added to the thickness of the sleeve 18 establishes the maximum thickness of the thus completed handle which is generally indicated at 19.

The width of the U-shaped portion 16 of the handle is considerably greater than the thickness thereof and it is preferred that even with the thickness added thereto by the sleeve 18, the handle width and thickness result in the handle being a loose fit within a rung 11 when inserted therein with the extremity of the angularly disposed end 17 oriented towards the tread 12 thereof. It is important that the handle width be less than the width of the plane between the upper and lower portions of the rung to ensure the necessary loose fit. The upturned end 17 is dimensioned to extend above the plane between the upper and lower portions of the rungs to an extent which does not interfere with the loose, free fit of the handle in a rung. When the inserted handle is released, the weight of the paint in the container 15 tilts the attachment slightly bringing the extremity of the end 17 into holding contact with the interior of the rung 11 securing the attachment against unwanted endwise movement and with the opposite end of the handle engaging the rung and functioning as a fulcrum. While the container 15 is not quite level, the length of the handle and the thickness of the sleeve renders the tilting movement of the attachment a negligible factor.

By way of examples and not of limitation, handle lengths in six to seven and one half inch range and plastic sleeves in die four to five inch range have been found to be satisfactory with respect to providing both secure support when held by a rung and a comfortable hand grip for use when a painter is standing on the ground or a staging. It is preferred that, as shown, one end of each sleeve 18 butts against the upturned end 17 with its other end spaced a short distance from the circular first portion 14.

In practice, the use of an attachment, when the user is not on a ladder is obvious. When the painter is to work while on a ladder, the handle of the attachment, still held by a hand, is inserted in a selected rung, without releasing the handle until, finally, it is held only by thumb and forefinger, the handle then inserted as far as necessary.

While the attachment can be palled from a rung, it is more easily removed by lifting the attachment holding the exposed part of the handle in the same manner to bring the end 17 down out of contact with the rung which ensures that, as the attachment is withdrawn, the sleeve 18 does not catch the rung where it is secured to the sides of the ladder 10 until the handle may be fully gripped.

It will be apparent from the foregoing that ladder attachments in accordance with the invention are of a construction ensuring low manufacturing and shipping costs and maximum convenience in use to those painting from a ladder or where a paint container is most conveniently used if hand held.

I claim:

1. In combination, a ladder for use by painters and of the type provided with hollow rungs having tread surfaces and which are generally circular at least below the tread surfaces, and an attachment to be held by a selected rung of the ladder and to hold an open container which is circular in cross section and of maximum size adjacent the open end of the container, said attachment comprising a rigid, circular first portion dimensioned to receive an open container with the received container held adjacent the upper end thereof, a rigid U-shaped second portion of a width less than the inside diameter of the rungs, the end of the second portion permanently secured to the first portion with both portions in the same plane, the free end of the second portion curved away from said plane in a direction establishing the upper surface of the attachment and a flexible sleeve of circular section frictionally fitted on the rigid second portion and rendered oblate when thus fitted and of a length such that the ends thereof are close to the first portion and the upturned end of the second portion to provide a handle dimensioned both to be held by one hand of the painter and to be a free fit in a selected end of a rung, the extremity of the upturned end of the second portion exposed above the sleeve, whereby the handle, when thus held, can be inserted in the rung until the container holding first portion is close to one side of the ladder and when released, the weight of the attachment externally of the ladder causes the upturned end to frictionally engage the undersurface of the tread surface and that portion of the sleeve overlying the open end of the rung to come into holding contact therewith until lifted from such engagement and pulled by one hand until the handle is exposed to be gripped and held thereby.

2. The attachment of claim 1 in which the length of the second portion is within the six to seven and one half inch range and the length of the sleeve is within the four to five inch range.

3. The attachment of claim 2 in which one end of the sleeve butts against the upturned end and the other end of the sleeve is spaced from but is close to the first portion.

* * * * *